United States Patent [19]

Requejo

[11] 4,302,348

[45] Nov. 24, 1981

[54] HARD SURFACE CLEANING COMPOSITIONS

[75] Inventor: Luz P. Requejo, Cincinnati, Ohio

[73] Assignee: The Drackett Company, Cincinnati, Ohio

[21] Appl. No.: 189,986

[22] Filed: Sep. 23, 1980

[51] Int. Cl.[3] ..... C11D 7/16; C11D 3/06

[52] U.S. Cl. ..... 252/135; 252/139; 252/162; 252/171; 252/523; 252/364; 252/DIG. 10; 252/524; 252/535

[58] Field of Search ..... 252/135, 523, 139, 162, 252/171, 364, DIG. 10, 137

[56] References Cited

U.S. PATENT DOCUMENTS

| | | | |
|---|---|---|---|
| 3,239,467 | 3/1966 | Lipinski | 252/144 |
| 3,463,735 | 8/1969 | Stonebraker et al. | 252/162 X |
| 3,591,510 | 7/1971 | Zenk | 252/526 |
| 3,882,038 | 5/1975 | Clayton et al. | 252/164 |
| 3,887,497 | 6/1975 | Ulvild | 252/526 |
| 3,929,680 | 12/1975 | Arai et al. | 252/542 |
| 4,086,178 | 4/1978 | Walker | 252/143 |
| 4,152,305 | 5/1979 | Berghausen | 252/523 |
| 4,175,062 | 11/1979 | Disch et al. | 252/540 |
| 4,213,873 | 7/1980 | Church | 252/162 X |

OTHER PUBLICATIONS

Brochure entitled, Introducing Unique New Monflor ®.

*Primary Examiner*—Mayer Weinblatt
*Attorney, Agent, or Firm*—Sharon A. Blinkoff; George A. Mentis

[57] ABSTRACT

A composition for cleaning a wide variety of hard surfaces in a no rinse mode, comprised of a mixture of organic solvents at least one having a low boiling point and at least one having a relatively higher boiling point, an alkali-metal polyphosphate, fugitive alkaline material, a first surfactant which is a nonionic or anionic surfactant, a second surfactant which is a fluorinated hydrocarbon anionic or nonionic surfactant, and water.

8 Claims, No Drawings

HARD SURFACE CLEANING COMPOSITIONS

BACKGROUND OF THE INVENTION

This invention relates to liquid compositions for cleaning a wide variety of hard surfaces such as metallic, plastic, tile, porcelain, glass and mirrored surfaces. More specifically this invention relates to hard surface cleaners which can be used in a no rinse mode whereby the composition is brought into contact with the surface to be cleaned and then removed therefrom by wiping the surface with a dry cloth.

In the past compositions for cleaning hard surfaces in a no rinse mode have been formulated specifically, as either glass and mirrored surface cleaners, or as general hard surface cleaners for cleaning a varity of surfaces other than glass or mirrored surfaces. As formulated these prior art cleaners could not be used interchangeably. One reason for this is that the general hard surface cleaners, in order to be effective in removing a wide variety of solids contained rather large quantities of nonvolatile ingredients such as surfactants and builders. Due to the high content of these nonvolatile ingredients the general hard surface cleaners tended to smear or streak glass or mirrored surfaces. Conversely when a glass or mirror cleaner was used on hard surfaces such as tile, metal, or porcelain, incomplete cleaning of soils such as grease resulted due to the low content of the nonvolatile ingredients in these cleaners.

An example of prior art compositions which were formulated primarily for cleaning glass and mirrored surfaces are those described in U.S. Pat. No. 3,463,735 to Stonebreaker et al. These compositions contain relatively minor amounts of nonvolatile ingredients, a surfactant and a builder, along with a mixture of volatile ingredients, a combination of solvents, ammonia and water. Applicant has surprisingly found that by adding as little as 0.011% by weight of a fluorinated hydrocarbon surfactant and by adjusting the levels of the volatile materials in the Stonebreaker et al. compositions, a composition is achieved which is capable of functioning equally well as both a glass and mirror cleaner and as a general hard surface cleaner.

SUMMARY OF THE INVENTION

Accordingly it is an object of this invention to provide a hard surface cleaner which is equally effective on all types of hard surfaces or porcelain, tile, or metallic surfaces, which is capable of effectively removing a wide variety of soils, and which will not smear or leave a film on glass or mirrored surfaces. It is yet a further object of the present invention to provide such a cleaning composition which can be used in a no rinse mode by applying the composition to a surface, which is to be cleaned, and then wiping it dry with a cloth. The soils on the surface are removed when the surface is wiped dry.

The compositions of this invention are comprised of the following ingredients (where the percentage amounts recited below and throughout the application are on a weight basis):

(a) from about 1.85% to about 10.00% of at least one lower aliphatic monohydric alcohol having a boiling point within the range of from about 75° C. to about 100° C.;

(b) from about 1.15% to about 10.00% of at least one lower alkylene or polyalkylene glycol or lower alkyl ether thereof, having a boiling point of between about 120° C. to about 250° C.;

(c) from about 0.1% to about 2.5% of a first surfactant which is a nonionic or anionic surfactant;

(d) from about 0.011% to about 5.000% of a second surfactant which is a nonionic or anionic fluorinated hydrocarbon surfactant;

(e) from about 0.02% to about 2.00% of an alkali-metal polyphosphate;

(f) from about 0.15% to about 3.00% of a fugitive alkaline material; and the balance being water.

DETAILED DESCRIPTION OF THE PREFERRED EMBODIMENT

In accordance with the present invention it has been found that a significant increase in cleaning efficiency can be obtained by adding minor amounts of an anionic or nonionic fluorinated hydrocarbon surfactant to a composition comprised of a combination of organic solvents, a lower aliphatic alcohol having a relatively low boiling point and a lower alkylene or polyalkylene glycol or a lower aliphatic ether thereof having a relatively higher boiling point; a first surfactant which is a nonionic or anionic surfactant that is compatible with the solvents; an alkali-metal polyphosphate; fugitive alkaline material; and water. Since only a minor amount of the fluorinated hydrocarbon surfactant (referred to herein as the second surfactant) is needed to achieve a significant increase in cleaning, the resultant composition has a very low concentration of nonvolatile ingredients, thereby resulting in a composition effective on all types of hard surfaces.

The lower aliphatic alcohols which are suitable for use in the compositions of the present invention are those having from two to four carbon atoms and having a boiling point within the range of about 75° C. to about 100° C. Examples of these are isopropyl alcohol, n-propyl alcohol, ethyl alcohol, sec-butyl alcohol, tert-butyl alcohol, and mixtures thereof. Lower aliphatic alcohols which do not possess the requisite boiling points are not suitable for use herein in that, those having a boiling point below 75° C. tend to evaporate too quickly to impart the desired effects, while those having boiling points in excess of 100° C. tend to evaporate too slowly. A particularly suitable lower aliphatic alcohol is ispropyl alcohol which has a boiling point of about 82.3° C.

These lower aliphatic alcohols may be present in amounts which vary from about 1.85% to about 10.00%. If less than 1.85% is used the desired effect of this ingredient, the tendency to increase the volatility of the total composition, will not be noticed, while using amounts in excess of about 10.00% will have a deleterious effect on the surfactants present. Amounts of this ingredient which are particularly suitable for use herein are from about 2.76% to about 3.5%.

The alkylene or polyalkylene glycols or the lower alkyl ethers thereof which are suitable for use in the instant compositions are those having boiling points of from about 120° C. to about 250° C. and those which are selected from the group consisting of alkylene and polyalkylene glycols containing from about 2 to 6 carbon atoms, and the lower alkyl ethers of alkylene or polyalkylene glycols, containing a total of about 3 to 8 carbon atoms wherein the alkyl ether contains a total of from about 1 to 4 carbon atoms. Examples of these compounds which are suitable are ethylene glycol, propylene glycol, trimethylene glycol, 1,2-butanediol, 1,3-butanediol, tetramethylene glycol, 1,2-pentanediol, 1,4-pentanediol, pentamethylene glycol, 2,3-hexanediol, hexamethylene glycol, glycol monoethyl ether, glycol monobutyl ether, glycol monomethyl ether, propylene glycol monoethyl ether, ethylene glycol monobutyl ether, diethylene glycol monoethyl ether and mixtures thereof. A particularly suitable compound for use herein is ethylene glycol monobutyl ether which has a boiling point of about 171° C.

These higher boiling point solvents can be present in amounts which vary from about 1.15% to about 10.00%. If less than 1.15% is employed this ingredient will not impart its desired effect, the increase in lubricity or ease by which the composition may be spread on a surface; while using more than 10.00% will have a deleterious effect on the detergency of the compositions. A particularly suitable amount of this ingredient for use herein is between about 1.73% to about 2.50%.

Using a combination of the organic solvents enumerated above, one having a relatively low boiling point and the other having a relatively higher boiling point is required in compositions of the instant type which are formulated to be used in a no rinse mode. The combination of these solvents in their respective concentrations will provide a sufficiently slow evaporation rate to promote easy spreading without rendering the evaporation rate so slow as to require excessive mopping for removal of these compositions.

The first surfactant is selected from the group of anionic and nonionic surfactants which are compatible with the organic solvents used herein. Examples of members of this group are the linear primary alcohol ethoxylates, such as the reaction product of a linear primary alcohol having from about 9 to about 11 carbon atoms reacted with an average of 2.5 moles of ethylene oxide; the alkyl aryl sulfonates; polyethylene oxide ethers of fatty alcohols; sodium lauryl sulfate; octyl phenoxy polyethoxy ethanol; sodium lauryl ether sulfate; and sodium dodecyl benzene sulfonate. A particularly suitable surtactant for use as the first surfactant is sodium lauryl sulfate.

The amount of this first surfactant present in the instant compositions can vary from about 0.1% to about 2.5%. A particularly suitable amount for use herein is from about 0.20% to about 0.30%.

The second surfactant is an anionic or nonionic fluorinated hydrocarbon surfactant. Examples of suitable second surfactants are the anionic fluorinated surfactants having a fluorinated hydrocarbon portion which exhibits a branched chain structure and having aliphatic per-fluorocarbon groups at one end of the molecule. One such surfactant is that sold by I.C.I Ltd. under the registered trademark of MONFLOR 31, which is the sodium salt of a branched chain perfluoroalkyenyl oxybenzene sulphonic acid of the formula: $C_{10}F_{19}OC_6H_4SO_3^{(-)}Na^{(+)}$. Other examples of suitable fluorinated anionic surfactants are those where the fluorinated hydrocarbon portion exhibits a straight chain structure, having aliphatic per-fluorocarbon groups at the end of the chain. One such surfactant is that sold by the 3M Company under the designation of FC 128, which is the potassium salt of a fluorinated alkyl carboxylate. Examples of suitable nonionic fluorinated surfactants are those where the fluorinated hydrocarbon portion exhibits a branched chain structure and which have aliphatic per-fluorocarbon groups at both ends of the chain such as those having the formula: $R_f(OCH_2CH_2)_nOR_f$, where $R_f$ is $C_8F_{15}$, $C_{10}F_{19}$, or $C_{12}F_{23}$ and n is from 10 to 30. Other suitable nonionic fluorinated hydrocarbon surfactants are those where the fluorinated hydrocarbon portion exhibits a branched chain structure and which have an aliphatic per-fluorocarbon group at one end of the chain, such as those having the formula: $R_f(OCH_2CH_2)_mOR$ where R is a lower alkyl, suitably $CH_3$, m is from 2 to 20 and $R_f$ is $C_8F_{15}$, $C_{10}F_{19}$, or $C_{12}F_{19}$.

A particularly suitable fluorinated hydrocarbon surfactant for use herein is the anionic surfactant sold under the trademark of MONFLOR 31 having the formula: $C_{10}F_{19}OC_6H_4SO_3^{(-)}Na^{(+)}$.

These fluorinated hydrocarbon surfactants can be present in the instant invention in amounts which range from 0.011% to about 5.000%. Using amounts of less than 0.011% will not provide the detergency necessary while using amounts in excess of 5.000% will increase the level of nonvolatile ingredients such that smearing will occur, additionally increasing the levels of this ingredient to 5.000% will not increase the detergency of the resultant compositions. A particularly suitable amount of the fluorinated hydrocarbon surfactant is from about 0.011% to about 0.099%.

The alkali metal polyphosphates which are suitable for use herein include sodium tripolyphosphate, tetra-sodium pyrophosphate, and sodium hexametaphosphate. The potassium salts of any of the foregoing are equally useful herein. A particularly suitable alkali metal polyphosphate is tetra-sodium pyrophosphate. Suitable amounts of this ingredient may vary from about 0.02% to about 2.00%. Using less than the 0.02% will decrease the efficiency of the composition in removing grease soils while using in excess of 2.00% will tend to cause smearing. A particularly suitable amount of this ingredient for use herein is from about 0.04% to about 0.08%.

Fugitive alkaline materials are used herein for their ability to improve detergency without increasing the level of nonvolatile ingredients, since these materials will evaporate from the surface being cleaned. Examples of suitable fugitive alkaline materials are ammonia and morpholine. The amount of this material which is useful herein can vary from about 0.15% to about 3.00%. Using less than about 0.15% will affect the ability of the formulation to remove greasy soils while using more than about 3.00% will result in the liberation of gases, which create an offensive odor. Although morpholine can be used herein it is preferable to use ammonia. When ammonia is used it may be conveniently added in the form of ammonium hydroxide, ammonium acetate and ammonium carbonate, however, if so added it should be added in quantities capable of producing suitable amounts of ammonia. A particularly suitable amount of the fugitive alkaline material for use herein is from about 0.30% to about 1.00%.

The last of the essential ingredients is water which will make up the balance of the composition. In order to achieve a composition with a low concentration of non-volatile ingredients, it has been found that the aqueous component should preferably be made up of deionized or soft water.

As optional ingredients these compositions may contain perfumes, dyes and solubilizing agents for the perfumes.

The compositions can be made by mixing the various ingredients in any suitable amount. In use these compositions are applied to a surface in any conventional manner such as spraying, pouring, etc. After being left in contact with the surface the composition is removed by wiping the surface with a clean dry absorbent material. After removal of the composition the surface is clean and requires no rinse. Due to the high contact of volatile ingredients in the instant compositions no film or residue is left on the surface, thereby preventing the resoiling of the surface.

The following examples illustrate the present invention:

EXAMPLE 1

A test was conducted to determine the effect of the fluorinated hydrocarbon surfactant in removing grease soils. In accordance with this test two compositions were prepared. Composition A and Composition B. Composition A, in accordance with the present invention, was comprised of the following ingredients by weight: 2.76% isopropyl alcohol; 1.73% ethylene glycol monobutyl ether; 0.20% sodium lauryl sulfate; 0.066% of MONFLOR 31, a 30% active solution of an anionic fluorinated hydrocarbon surfactant having the formula: $C_{10}F_{19}OC_6H_4SO_3^{(-)}Na^{(+)}$ in a mixture of isopropanol and water; 0.60% of ammonium hydroxide; 0.04% tetrasodium pyrophosphate; 0.04% perfume; 0.05% of a solubilizing agent for the perfume, a nonionic surfactant; and the balance being deionized water. Composition B which was not a composition of the present invention was comprised of the following ingredients by weight: 4.0% isopropyl alcohol; 2.5% of ethylene glycol monobutyl ether; 0.10% sodium lauryl sulfate; 0.60% ammonium hydroxide; 0.01% tetrasodium pyrophosphate; 0.01% perfume; 0.01% solubilizing agent for perfume, a nonionic surfactant; and the balance being deionized water. Both compositions were applied to plates containing grease soils which were prepared in the manner described below.

The plates used in this test were made of glass and were rectangular in shape having the approximate dimensions of 17¾ inches by 6¾ inches. Each plate was soiled by drawing horizontal lines across the plate at ¾ inch intervals with a Blaisdell red grease marker. The intensity of these lines was varied after every fourth line. This was done by increasing the number of strokes per line which were made with the marker, one extra stroke per line after every fourth line. The first four lines on the plate were made using two strokes of the marker and to increase the intensity of the lines an extra stroke was used for each line, on each successive group of four lines. This resulted in the first group of four lines being made by two strokes of the marker, the second group of four lines being made by three strokes of the marker, the third group of four lines being made with four strokes of the marker and so on until the plate was completely lined.

A piece of masking tape was then placed on two plates, which were soiled in the manner described above. The tape was placed along the center line of the plates dividing them in half lengthwise. After this was done approximately 2 grams of Composition A were applied to the right side of one plate and approximately 2 grams of this Composition were applied to the left side of the other plate. Equal amounts of Composition B were applied to the opposite sides of each of these plates.

The total number of lines removed by Composition A on each side of the two plates was then divided by the total number of lines which were present on the plate prior to its being cleaned. This figure was then multiplied by 100% to give the percentage of cleaning for Composition A. The figures thus obtained for each half of the two plates were then added and divided by two to give an average of the percentage of cleaning. This same procedure was followed for the halves of the two plates which were cleaned with Composition B.

The average percentage of cleaning obtained using Composition A was 98%, while the average percentage of cleaning obtained using Composition B was 20%.

From the foregoing it is apparent that the addition of a fluorocarbon surfactant significantly increases the ability of the present compositions to remove grease.

EXAMPLE 2

Two compositions, C and D, were prepared and tested for their relative ability to remove aged fat. Composition C being the same as Composition A of the preceding example except that the level of ammonium hydroxide was increased to 1.0% from 0.60%.

Several soiled glass plates were prepared by spraying a fat solution, containing 3% to 5% of beef fat in hexane, onto each of the plates. After the fat was applied it was smeared over the surface of the plate with a sweeping motion to insure that the fat film evenly covers the entire surface of the plate. The plates thus soiled were then aged for a period of 55 days.

A drop of Composition C was then placed on the surface of a soiled plate and allowed to remain in contact with the film for a predetermined number of minutes, as indicated in the table below. At the end of the predetermined time the plate was shaken by hand to remove the composition and then flushed gently with deionized water. The area of the plate in contact with the composition was then examined visually for completeness of removal of the fat film. The results of these observations are given in the table below. Following the tests conducted with Composition C the identical tests were conducted with Composition D, the results of which are also given in the table below.

| | Contact Time (Min) | Extent of Film Removal in % of Total Fat Removed |
|---|---|---|
| Composition C | 2 | 35% |
| Composition D | 2 | 10% |
| Composition C | 3 | 50% |
| Composition D | 3 | 10% |
| Composition C | 4 | 90% |
| Composition D | 4 | 10% |
| Composition C | 5 | 99-100% |
| Composition D | 5 | 10% |

From the foregoing it should be apparent that Composition C, containing the fluorinated hydrocarbon surfactant in accordance with the present invention, has a significantly greater ability to remove fat soils than that of Composition D which does not contain such a surfactant.

The following numbered examples of complete specific embodiments serve to further illustrate the practise of this invention. In these examples all proportions are on a percent by weight basis.

EXAMPLE 3

| Ingredient | % by Weight |
|---|---|
| Isopropyl alcohol | 2.76% |
| Ethylene glycol monobutyl ether | 1.73% |
| Octyl phenoxypoly ethoxy ethanol | 0.20% |
| Tetra-sodium pyrophosphate | 0.04% |

EXAMPLE 3-continued

| Ingredient | % by Weight |
|---|---|
| MONFLOR 31 | 0.066% |
| Ammonium hydroxide | 0.60% |
| Perfume | 0.04% |
| Solubilizing agent for perfume | 0.05% |
| Deionized water | 94.514% |

EXAMPLE 4

| Ingredient | % by Weight |
|---|---|
| Isopropyl alcohol | 2.76% |
| Ethylene glycol monobutyl ether | 1.73% |
| Sodium dodecyl benzene sulfonate | 0.20% |
| Tetra-sodium pyrophosphate | 0.04% |
| MONFLOR 31 | 0.066% |
| Ammonium hydroxide | 0.60% |
| Perfume | 0.04% |
| Solubilizing agent for perfume | 0.05% |
| Deionized water | 99.514% |

EXAMPLE 5

| Ingredient | % by Weight |
|---|---|
| Isopropyl alcohol | 4.0% |
| Ethylene glycol monobutyl ether | 2.5% |
| Neodol 91-2.5* | 0.30% |
| Tetra-sodium pyrophosphate | 0.04% |
| MONFLOR 31 | 0.099% |
| Ammonium carbonate | 1.60% |
| Perfume | 0.04% |
| Solubilizing agent for perfume | 0.05% |
| Deionized water | 91.371% |

*Neodol 91-2.5 - a nonionic surfactant available from the Shell Oil Company which is a linear primary alcohol ethoxylate, the reaction product of one mole of a linear primary alcohol having from 9 to 11 carbon atoms with an average of 2.5 moles of ethylene oxide.

EXAMPLE 6

| Ingredient | % by Weight |
|---|---|
| Isopropyl alcohol | 3.08% |
| Ethylene glycol monobutyl ether | 1.92% |
| Sodium Lauryl sulfate | 0.20% |
| Tetra-sodium pyrophosphate | 0.04% |
| MONFLOR 31 | 0.066% |
| Ammonium acetate | 0.01% |
| Perfume | 0.04% |
| Solubilizing agent for perfume | 0.05% |
| Deionized water | 93.404% |

Having described some typical embodiments of this invention it is not my intent to be limited to the specific details set forth herein. Rather, I wish to reserve to myself any variations or modifications that may appear to those skilled in the art and fall within the scope of the following claims.

What I claim is:

1. A cleaning composition for hard surfaces consisting essentially by weight of:

(a) from about 1.85% to about 10.00% of at least one organic solvent which is a lower aliphatic monohydric alcohol having from about 2 to about 4 carbon atoms and having a boiling point within the range of from about 75° C. to about 100° C.;

(b) from about 1.15% to about 10.00% of at least one organic solvent having a boiling point of between about 120° C. to about 250° C. and selected from the group consisting of alkylene and polyalkylene glycols having from about 2 to 6 carbon atoms, and the lower alkyl ethers, having about 1 to 4 carbon atoms, of alkylene or polyalkylene glycols containing a total of from about 3 to 8 carbon atoms;

(c) from about 0.1% to about 2.5% of a first surfactant which is an anionic or nonionic surfactant selected from the group consisting of linear primary alcohols having from about 9 to about 11 carbon atoms reacted with an average of 2.5 moles of ethylene oxide, alkyl aryl sulfonates, polyethylene oxide ethers of fatty alcohols, sodium lauryl sulfate, octyl phenoxy polyethoxy ethanol, sodium lauryl ether sulfate, and sodium dodecyl benzene sulfonate;

(d) from about 0.011% to about 5.000% of a second surfactant which is an anionic or nonionic fluorinated hydrocarbon surfactant selected from the group consisting of:

(i) anionic fluorinated hydrocarbon surfactants wherein the fluorinated hydrocarbon portion has a branched chain structure and having aliphatic per-fluorocarbon groups at one end thereof;

(ii) nonionic fluorinated hydrocarbon surfactants having a fluorinated hydrocarbon portion exhibiting a branched structure and having the formula:

$$R_f(OCH_2CH_2)_nOR_f$$

wherein $R_f$ is $C_8F_{15}$, $C_{10}F_{19}$ or $C_{12}F_{23}$ and n is an integer from 10 to 30;

(iii) nonionic fluorinated hydrocarbon surfactants wherein the fluorinated hydrocarbon portion exhibits a branched structure and having the formula:

$$R_f(OCH_2CH_2)_mOR$$

wherein $R_f$ is as in (ii), R is a lower alkyl and m is an integer from 2 to 10; and (iv) anionic fluorinated hydrocarbon surfactants wherein the fluorinated hydrocarbon portion exhibits a straight chain structure and having aliphatic per-fluorocarbon groups at one end of the chain thereof;

(e) from about 0.02% to about 2.0% of an alkali-metal polyphosphate selected from the group consisting of the sodium or potassium salts of tripolyphosphate, hexametaphosphate, and tetra-sodium or potassium pyrophosphate;

(f) from about 0.15% to about 3.00% of a fugitive alkaline material which can be ammonia, or morpholine; and (g) the balance of said composition being water.

2. The composition of claim 1 wherein the second surfactant is the sodium salt of a branched chain perfluoroalkyenyl oxybenzene sulphonic acid having the formula:

$$C_{10}F_{19}OC_6H_4SO_3^{(-)}Na^{(+)}.$$

3. The composition of claim 2 wherein the organic solvent having a boiling point of between about 75° C. to about 100° C. is isopropyl alcohol; and wherein the organic solvent having a boiling point of between about 120° C. to about 250° C. is ethylene glycol monobutyl ether.

4. The composition of claim 3 wherein the fugitive alkaline material is ammonia.

5. The composition of claim 4 wherein the surfactant is sodium lauryl sulfate.

6. The composition of claim 5 wherein the alkali-metal polyphosphate is tetra-sodium pyrophosphate.

7. The composition of claims 1 or 6 wherein the organic solvent having a boiling point of between about 75° C. to about 100° C. is present from about 2.76% to about 3.50% by weight; wherein the organic solvent having a boiling point of between about 120° C. to about 250° C. is present from about 1.73% to about 2.50% by weight; wherein the first surfactant is present from about 0.20% to about 0.30% by weight; wherein the second surfactant is present from about 0.011% to about 0.099% by weight; wherein the alkali-metal polyphosphate is present from about 0.04% to about 0.08% by weight; and wherein the fugitive alkaline material is present from about 0.30% to about 1.00% by weight.

8. A process for cleaning hard surfaces which comprises the steps of applying a composition in accordance with claim 1 to a hard surface and then removing said composition by wiping said surface with a substantially dry absorbent material.

* * * * *